US011411670B1

(12) United States Patent
Lee et al.

(10) Patent No.: US 11,411,670 B1
(45) Date of Patent: Aug. 9, 2022

(54) CHIRP NOISE GENERATION DEVICE AND METHOD FOR COMPRESSION PULSE SIGNAL

(71) Applicant: AGENCY FOR DEFENSE DEVELOPMENT, Daejeon (KR)

(72) Inventors: Junghoon Lee, Daejeon (KR); Jeil Jo, Daejeon (KR)

(73) Assignee: AGENCY FOR DEFENSE DEVELOPMENT, Daejeon (KR)

( * ) Notice: Subject to any disclaimer, the term of this patent is extended or adjusted under 35 U.S.C. 154(b) by 0 days.

(21) Appl. No.: 17/322,434

(22) Filed: May 17, 2021

(30) Foreign Application Priority Data

Apr. 1, 2021 (KR) ..... 10-2021-0042987

(51) Int. Cl.
*H04K 3/00* (2006.01)

(52) U.S. Cl.
CPC ..... *H04K 3/44* (2013.01)

(58) Field of Classification Search
CPC ..... H04K 3/44
See application file for complete search history.

(56) References Cited

U.S. PATENT DOCUMENTS 4,743,905 A * 5/1988 Wiegand ..... G01S 7/38 342/14
6,618,007 B1 * 9/2003 Miller ..... H01Q 3/2605 342/373
10,222,454 B2 3/2019 Lilburn et al.

FOREIGN PATENT DOCUMENTS

JP 2002328160 11/2002
KR 102149456 8/2020

* cited by examiner

*Primary Examiner* — Hsinchun Liao
(74) *Attorney, Agent, or Firm* — Dickinson Wright PLLC

(57) ABSTRACT

A chirp noise generation device for a compressed pulse signal includes: a receiving antenna; a signal analysis unit configured to determine whether to perform an electronic attack by analyzing a receipt signal that is inputted through the receiving antenna; and a digital frequency storage configured to store the receipt signal that is inputted through the receiving antenna, to generate a chirp noise by using the receipt signal, to generate a jamming signal by synthesizing the receipt signal and the chirp noise, and to transmit the jamming signal when a control command indicating that the electronic attack needs to be performed is received from the signal analysis unit.

11 Claims, 6 Drawing Sheets

CHIRP NOISE GENERATION DEVICE AND METHOD FOR COMPRESSION PULSE SIGNAL

RELATED APPLICATIONS

This application claims priority to and benefits of Korean Patent Application No. 10-2021-0042987, filed in the Korean Intellectual Property Office on Apr. 1, 2021, the entire contents of which are incorporated herein by reference.

FIELD

Embodiments of the present disclosure relates to a chirp noise generation device and a method for a compressed pulse signal.

BACKGROUND

Electronic warfare is a military activity involving the use of electronic energies to detect, exploit, and impede the use of enemy radio waves and to compensate for the use of friendly electromagnetic waves. As one of the functions of the electronic warfare, there is an electronic attack that uses radio waves or directly irradiates electromagnetic waves against enemy command and control, communications, and electronic weapon systems with enemy command and control, communications, and electronic weapon systems. For example, various types of electronic attacks may be performed to obstruct radar tracking in response to radar tracking of a target by receiving an echo signal, which is a reflected signal from the target.

The electronic attacks may be largely classified into noise (or noise jamming) and deception. When an electronic attack technique is noise, the electronic attack may be performed by using a noise generating plate. The noise may be divided into narrowband and wideband based on relative criteria rather than absolute criteria. When the electronic attack technique is deception, the electronic attack may be performed by using a digital radio frequency memory (DRFM). The digital radio frequency memory may also generate noise while changing to an arbitrary frequency within a certain bandwidth in addition to the deception.

The digital radio frequency memory generates noise of one frequency for a certain period of time by using a linear feedback shift register (LFSR), so a certain time period is required up to when a target bandwidth is generated. Therefore, there is a disadvantage that a certain time period is required when noise corresponding to a threat signal is generated in the digital radio frequency memory.

The above information disclosed in this Background section is only for enhancement of understanding of the background of the disclosure, and therefore, it may contain information that does not form the prior art that is already known in this country to a person of ordinary skill in the art.

BRIEF SUMMARY

Embodiments of the present disclosure has been made in an effort to provide a chirp noise generation device and method capable of generating noise within a single pulse.

Technical objects desired to be achieved in embodiments of the present disclosure are not limited to the aforementioned objects, and other technical objects not described above will be apparent to those skilled in the art from the disclosure of the present disclosure.

An exemplary embodiment of the present disclosure provides a chirp noise generation device for a compressed pulse signal, including: a receiving antenna; a signal analysis unit configured to determine whether to perform an electronic attack by analyzing a receipt signal that is inputted through the receiving antenna; and a digital frequency storage configured to store the receipt signal that is inputted through the receiving antenna, to generate a chirp noise by using the receipt signal, to generate a jamming signal by synthesizing the receipt signal and the chirp noise, and to transmit the jamming signal when a control command indicating that the electronic attack needs to be performed is received from the signal analysis unit.

The signal analysis unit may analyze the receipt signal and may transmit a pulse width and a chirp noise modulation bandwidth to the digital frequency storage.

The digital frequency storage may generate the chirp noise based on the pulse width and the chirp noise modulation bandwidth received from the signal analysis unit.

The digital frequency storage may generate the jamming signal by summing a phase of the receipt signal and a phase of the chirp noise.

The phase of the receipt signal may be calculated by using an equation $$\theta_s = \operatorname{atan}\left(\frac{Q}{I}\right),$$

and $\theta_s$ may indicate the phase of the receipt signal, I may indicate a magnitude of an in-phase, and Q may indicate a magnitude of a quadrature phase.

The digital frequency storage may generate the jamming signal by multiplying the receipt signal and the chirp noise in a time domain.

A frequency bandwidth of the jamming signal may be equal to a sum of a frequency bandwidth of the receipt signal and the chirp noise modulation bandwidth.

Another embodiment of the present disclosure provides a chirp noise generation method for a compressed pulse signal, including: receiving a chirp noise modulation bandwidth and a pulse width of a chirp noise depending on analysis contents of a receipt signal inputted through a receiving antenna; generating the chirp noise based on the pulse width and the chirp noise modulation bandwidth; and generating a jamming signal by synthesizing the receipt signal and the chirp noise, and transmitting the jamming signal.

The chirp noise generation method may further include: determining whether to perform an electronic attack by analyzing the receipt signal; and storing the receipt signal depending on a control command indicating that the electronic attack needs to be performed.

The jamming signal may be generated by summing a phase of the receipt signal and a phase of the chirp noise.

The phase of the receipt signal may be calculated by using an equation $$\theta_s = \operatorname{atan}\left(\frac{Q}{I}\right),$$

and $\theta_s$ may indicate the phase of the receipt signal, I may indicate a magnitude of an in-phase, and Q may indicate a magnitude of a quadrature phase.

The jamming signal may be generated by multiplying the receipt signal and the chirp noise in a time domain.

A frequency bandwidth of the jamming signal may be equal to a sum of a frequency bandwidth of the receipt signal and the chirp noise modulation bandwidth.

In accordance with the chirp noise generation device according to an embodiment of the present disclosure, it is possible to effectively interfere with the detection and tracking of the target of the radar by synthesizing the generated chirp noise with the receipt signal by using the receipt signal and transmitting it.

DETAILED DESCRIPTION

Embodiments of the present disclosure will be described more fully hereinafter with reference to the accompanying drawings, in which exemplary embodiments of the disclosure are shown. As those skilled in the art would realize, the described embodiments may be modified in various different ways, all without departing from the spirit or scope of the present disclosure.

To clearly describe embodiments of the present disclosure, parts that are irrelevant to the description are omitted, and like numerals refer to like or similar constituent elements throughout the specification.

In addition, unless explicitly described to the contrary, the word "comprise" and variations such as "comprises" or "comprising" will be understood to imply the inclusion of stated elements but not the exclusion of any other elements.

Hereinafter, a chirp noise generation device and method for a compressed pulse signal according to an embodiment of the present disclosure will be described with reference to FIG. 1 to FIG. 6.

Figure 1:
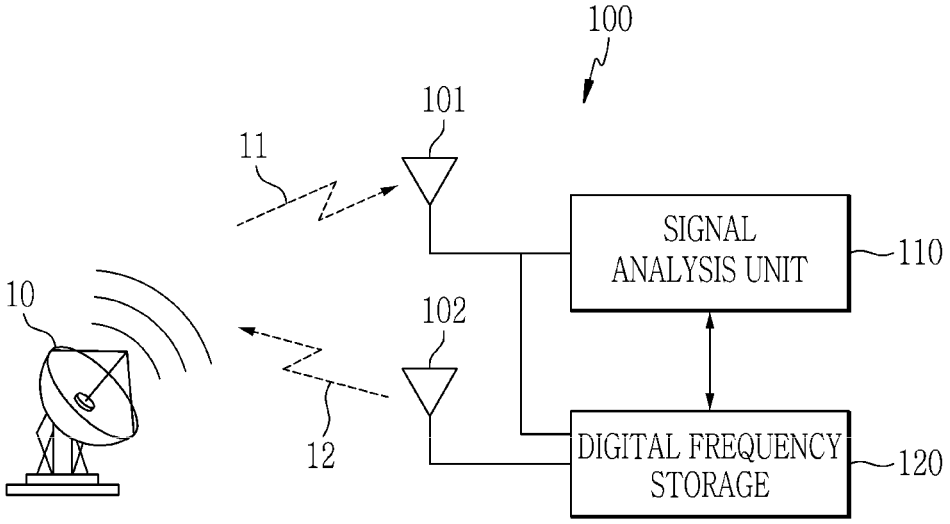
FIG. 1 illustrates a block diagram showing a chirp noise generation device for a compressed pulse signal according to an embodiment of the present disclosure.

FIG. 1 illustrates a block diagram showing a chirp noise generation device for a compressed pulse signal according to an embodiment of the present disclosure.

The chirp noise generation device 100 for the compressed pulse signal includes a receiving antenna 101, a transmission antenna 102, a signal analysis unit 110, and a digital frequency storage 120.

A signal 11 transmitted from a radar 10 is inputted to the signal analysis unit 110 through the receiving antenna 101. The radar 10 may be a compressed pulse radar that searches and tracks a target by using a compressed pulse signal as the transmitted signal 11.

The signal analysis unit 110 analyzes a center frequency, a pulse width, a pulse period, and an intra-pulse modulation bandwidth of a receipt signal inputted through the reception antenna 101. The signal analysis unit 110 transmits and receives necessary information to the digital frequency storage 120 depending on analyzed contents. When it is necessary to perform an electronic attack based on analysis of the signal analysis unit 110, the same receipt signal from the receiving antenna 101 is inputted to the digital frequency storage 120. That is, the receipt signal received through the receiving antenna 101 is simultaneously received by the signal analysis unit 110 and the digital frequency storage 120, and the signal analysis unit 110 analyzes the receipt signal that is inputted through the receiving antenna 101, and when it is determined that it is necessary to perform an electronic attack by determining whether or not to perform the electronic attack, transmits a control command to the digital frequency storage 120. The digital frequency storage 120 stores the receipt signal inputted through the receiving antenna 101 when a control command indicating that an electronic attack is required to be performed is received from the signal analysis unit 110. The receipt signal stored in the digital frequency storage unit 120 may be used as a signal for noise or deception. That is, the digital frequency storage unit 120 may generate a chirp noise by using the receipt signal, may synthesize the receipt signal and the chirp noise to generate a jamming signal 12, and transmit the jamming signal 12 through the transmission antenna 102.

A method of generating the jamming signal 12 by generating a jamming noise by using the receipt signal of a compressed pulse of the radar 10 and synthesizing the receipt signal and the jamming noise will be described in more detail with reference to FIG. 2 to FIG. 6 as well as FIG. 1.

Figure 2:
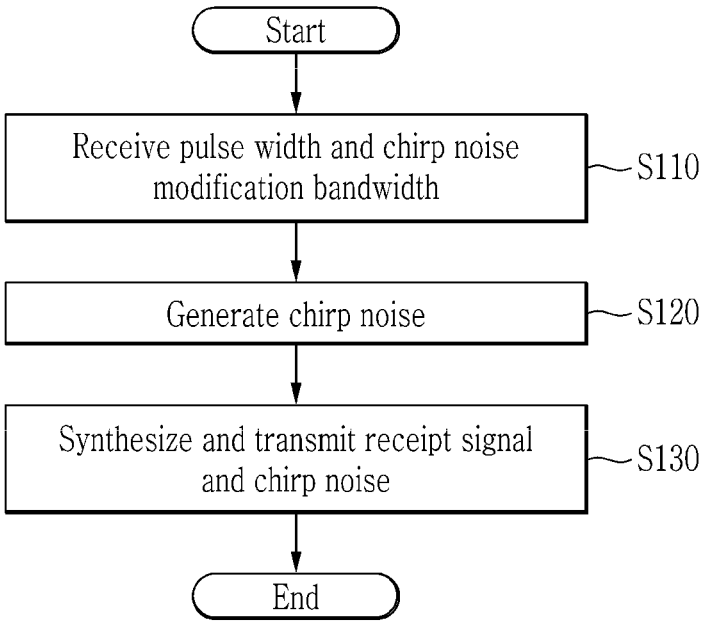
FIG. 2 illustrates a flowchart showing a chirp noise generation method for a compressed pulse signal according to an embodiment of the present disclosure.
Figure 3:
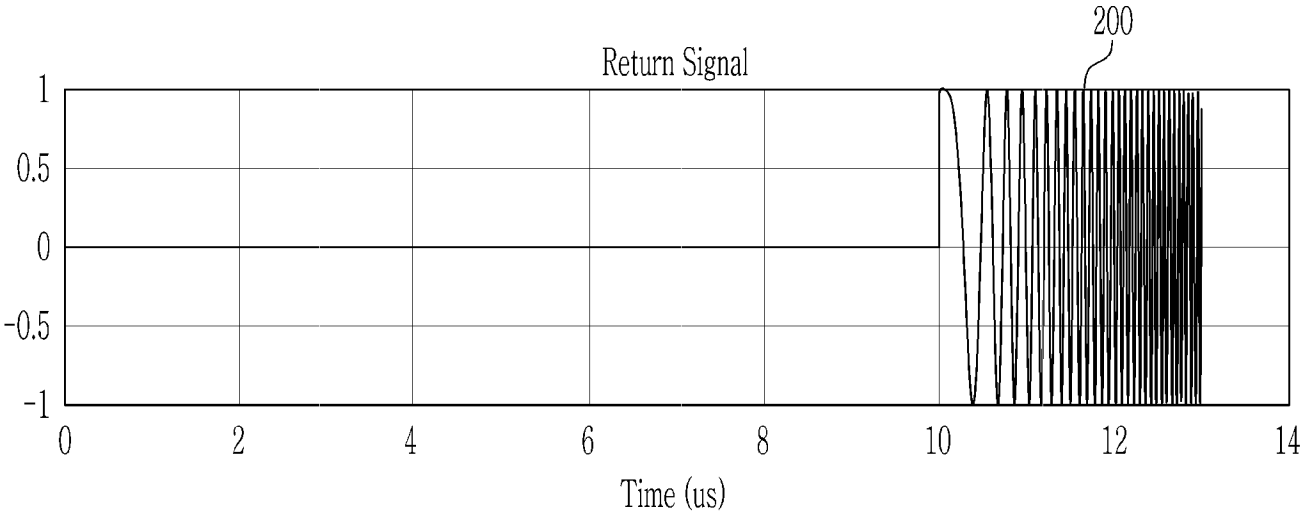
FIG. 3 illustrates an example of a receipt signal passing through a matching filter of a radar.
Figure 4:
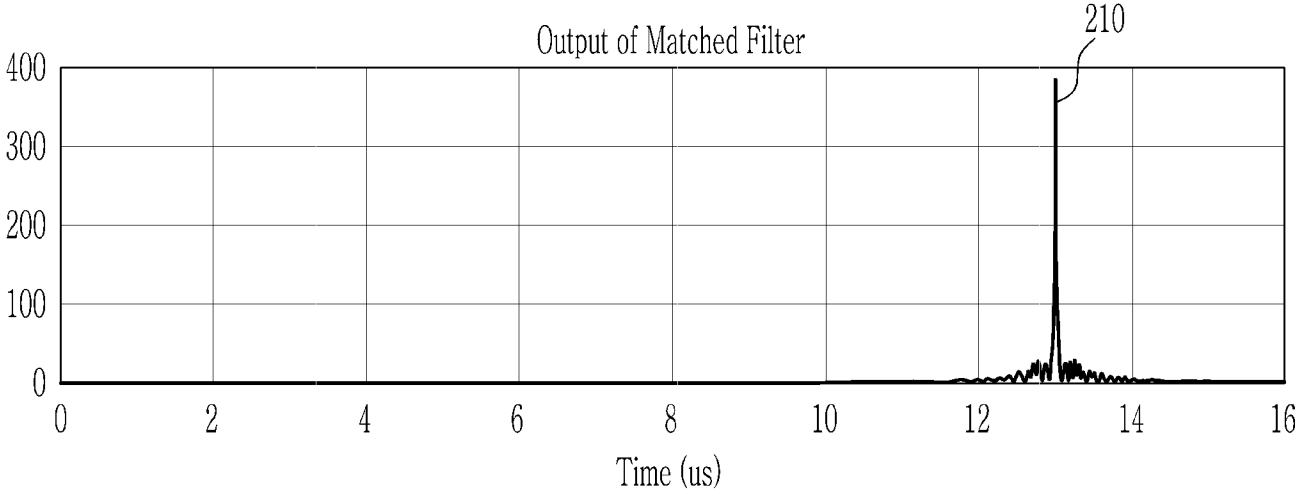
FIG. 4 illustrates an example of an output signal that is outputted after passing through a matching filter of a radar.
Figure 5:
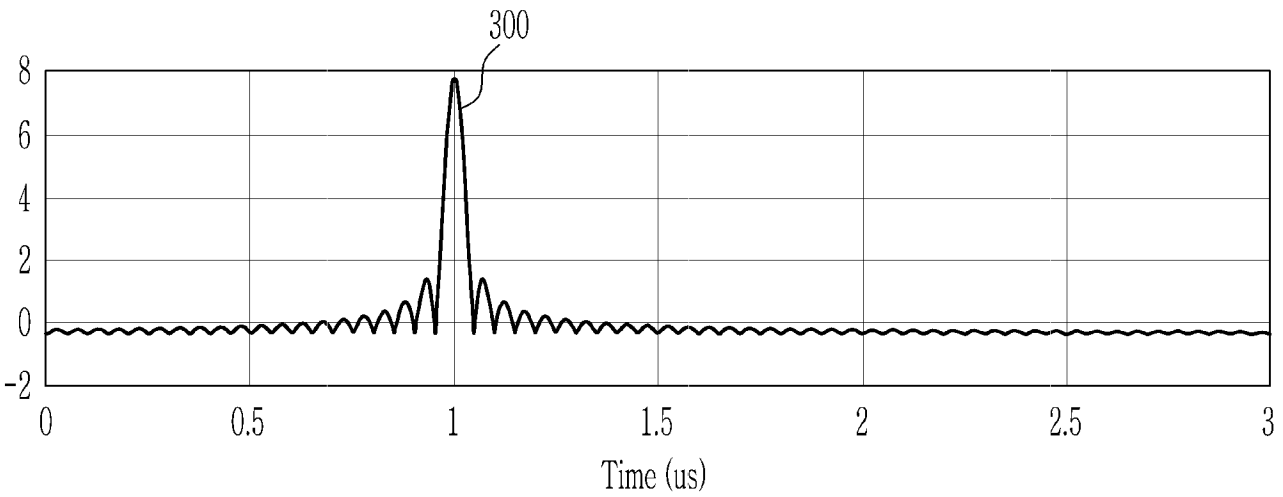
FIG. 5 illustrates an example of an output signal that is outputted after passing through a matching filter of a radar when only a target delay signal is received by the radar.
Figure 6:
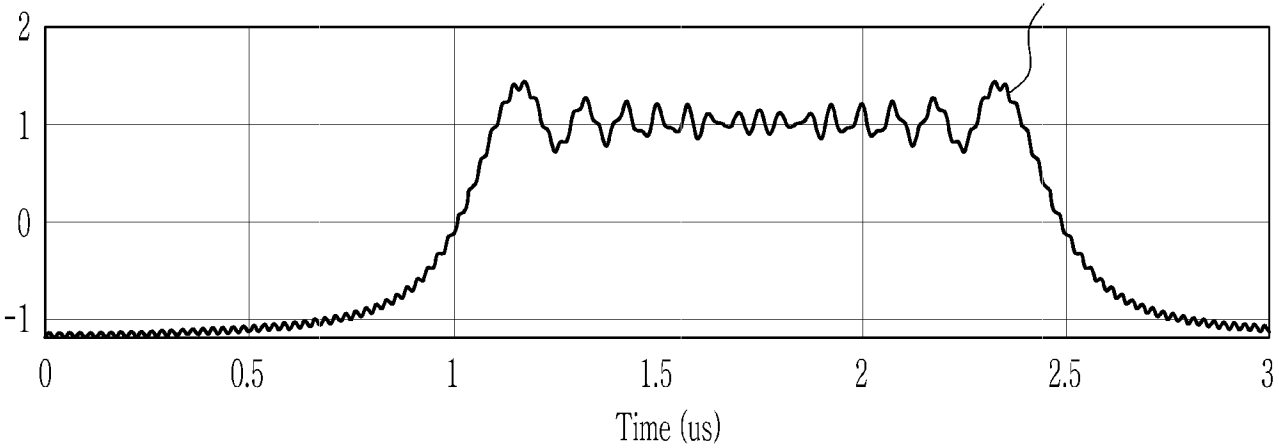
FIG. 6 illustrates an example of an output signal that is outputted after passing through a matching filter of a radar when chirp noise is added into a target delay signal and is received by the radar.

FIG. 2 illustrates a flowchart showing a chirp noise generation method for a compressed pulse signal according to an embodiment of the present disclosure. FIG. 3 illustrates an example of a receipt signal passing through a matching filter of a radar. FIG. 4 illustrates an example of an output signal that is outputted after passing through a matching filter of a radar. FIG. 5 illustrates an example of an output signal that is outputted after passing through a matching filter of a radar when only a target delay signal is received by the radar. FIG. 6 illustrates an example of an output signal that is outputted after passing through a matching filter of a radar when chirp noise is added into a target delay signal and is received by the radar.

Referring to FIG. 2 to FIG. 6, the signal analysis unit 110 analyzes a center frequency, a pulse width, a pulse period, and a modulation bandwidth of the receipt signal of the compressed pulse, and transmits necessary information to the digital frequency storage 120 depending on analyzed contents. That is, the signal analysis unit 110 may transmit the pulse width and the modulation bandwidth of the receipt signal to the digital frequency storage unit 120 as a pulse width and a chirp noise modulation bandwidth of the chirp noise. The digital frequency storage unit 120 may receive the pulse width and the chirp noise modulation bandwidth of the chirp noise from the signal analysis unit 110 (S110).

In general, the receipt signal of the compressed pulse may be expressed as Equation 1.

$$s(t) \sim \exp\left(j2\pi\left(f_o(t-t_i) + \frac{K_s}{2}(t-t_i)^2\right)\right) \quad \text{(Equation 1)}$$

Herein, S(t) indicates the receipt signal of the compressed pulse, $f_0$ indicates the center frequency of the receipt signal, $t_i$ indicates a time delay $K_s(=B_s/T_s)$ indicates a chirp rate, $B_s$ indicates a modulation bandwidth (frequency bandwidth), and $T_s$ indicates a pulse width. It is assumed that a magnitude of the receipt signal of the compressed pulse is 1.

A signal reflected by the target is inputted to a receiver of the radar 10, and the signal received by the radar 10 passes through a matching filter included in the radar 10 and is then outputted as illustrated in Equation 2. The matching filter is a linear filter in which a ratio of a mean square value of a signal component and a mean square value of a noise component is maximized at a point in an output for an input in which additional noise is superimposed on a desired signal component.

$$\begin{aligned} S_{out}(t) &= \int_{-\infty}^{\infty} s(t-\tau)h(\tau)d\tau \\ &= \int_{-T_s/2}^{T_s/2} \exp\Big(j2\pi\big(f_c(t-\tau-t_i) + \frac{K_s}{s}(t-\tau-t_i)^2\big)\exp\Big(j2\pi\Big(f_c\tau + \frac{K_s\tau^2}{2}\Big)\Big)d\tau \\ &= T_s\exp\Big(j2\pi\big(f_c(t-\tau-t_i) + \frac{K_s}{2}(t-\tau-t_i)^2\big)\mathrm{sinc}[KT_s(t-t_i)] \end{aligned} \quad \text{(Equation 2)}$$

Herein, $S_{out}(t)$ indicates a signal outputted after passing through the matching filter, and $f_c$ indicates a carrier frequency.

$$h(\tau) = \exp\Big(j2\pi\Big(f_c\tau + \frac{K_s\tau^2}{2}\Big)\Big) \text{ and } \mathrm{sinc}(t) = \frac{\sin(\pi t)}{\pi t} \text{ are}$$

used for the matching filter.

A received signal 200 that has passed through the matching filter according to Equation 2 is shown in FIG. 3. When the pulse width is 3 [μs] and the delay time is 10 [μs], an output signal 210 outputted after passing through the matching filter is outputted in the form of a sinc signal as illustrated in FIG. 4.

On the other hand, the receipt signal of the compressed pulse received from the digital frequency storage 120 of the chirp noise generation device 100 may be expressed as Equation 3.

$$s(t) \sim \exp\Big(j2\pi\Big(f_d t + \frac{K_s}{2}t^2\Big)\Big) \quad \text{(Equation 3)}$$

Herein, s(t) indicates the receipt signal of the compressed pulse, and $f_d$ indicates the center frequency of the digital frequency storage 120.

The digital frequency storage 120 receives a pulse width and the chirp noise modulation bandwidth that are the same as a pulse width $T_s$ and a modulation bandwidth $B_s$ analyzed by the signal analysis unit 110 from the signal analysis unit 110. That is, the signal analysis unit 110 transmits, to the digital frequency storage 120, a pulse width that is equal to a pulse width of the receipt signal of the compressed pulse, and the chirp noise modulation bandwidth that is equal to the modulation bandwidth of the receipt signal of the compressed pulse.

The digital frequency storage 120 generates a chirp noise based on the pulse width and the chirp noise modulation bandwidth received from the signal analysis unit 110 (S120). The digital frequency storage 120 may generate a chirp noise as shown in Equation 4.

$$R(t) \sim \exp(j\pi K_j t^2) \quad \text{(Equation 4)}$$

Herein, R(t) indicates the chirp noise, $K_j(=B_j/T_j)$ indicates a chirp noise rate, indicates the chirp noise modulation bandwidth, and $T_j$ indicates the pulse width. It is assumed that a magnitude of the chirp noise is 1. In this case, the noise phase becomes $\theta_j = \pi K_j t^2$ [rad].

The digital frequency storage 120 synthesizes and transmits the receipt signal and the chirp noise (S130). The digital frequency storage 120 may perform phase sampling, and may detect and store a phase value irrespective of the magnitude of the receipt signal through the phase sampling. The phase value may be expressed as an atan function for an inphase and a quadrature phase as shown in Equation 5.

$$\theta_s = \mathrm{atan}\Big(\frac{Q}{I}\Big) \quad \text{(Equation 5)}$$

Herein, $\theta_s$ indicates the phase value, I indicates a magnitude of an in-phase, and Q indicates a magnitude of an orthogonal phase.

The digital frequency storage 120 may generate the jamming signal 12 as shown in Equation 6 by summing a phase of the receipt signal and a phase of the jamming noise.

$$\theta_j = \theta_s + \theta_r \quad \text{(Equation 6)}$$

Herein, $\theta_s$ indicates the phase of the receipt signal (transmission signal 11 of the radar 10), $\theta_r$ indicates the phase of the jamming noise generated by the digital frequency storage 120, and $\theta_j$ indicates the phase of the jamming signal 12 transmitted from the digital frequency storage 120. That is, the digital frequency storage 120 may generate the jamming signal 12 by summing the phase of the transmission signal 11 of the radar 10 and the phase of the chirp noise.

The digital frequency storage 120 may generate the jamming signal by multiplying the receipt signal of the compressed pulse and the jamming noise in a time domain as shown in Equation 7.

$$J(t) \sim \exp(j2\pi f_d t + j\pi K_s t^2)B\cdot\exp(j\pi K_j t^2) = B\cdot\exp(j2\pi f_d t + j\pi(K_s+K_j)t^2) \quad \text{(Equation 7)}$$

Herein, J(t) indicates the jamming signal, and B indicates a magnitude of the jamming signal. When the jamming signal is generated by phase synthesis according to Equation 6, B becomes 1. An amplifier positioned inside or outside the digital frequency storage 120 amplifies and transmits the jamming signal generated as in. Equation 7 in order to transmit the jamming signal, and thus the finally transmitted jamming signal 12 may be expressed as in Equation 8.

$$J(t) = AB\exp(j2\pi f_d t + j\pi(K_s+K_j)t^2) \quad \text{(Equation 8)}$$

Herein, A is an amplification factor of the amplifier. In the case of phase synthesis, B becomes 1. That is, the digital frequency storage 120 may amplify the jamming signal generated by multiplying the receipt signal of the compressed pulse and the jamming noise in the time domain by the amplification factor of the amplifier, and may transmit it as the final jamming signal 12.

A frequency bandwidth of the receipt signal of the compressed pulse of the radar 10 received by the digital frequency storage 120 is $B_s$, and since the digital frequency storage 120 adds the jamming noise when transmitting the jamming signal 12, the jamming signal 12 of a frequency bandwidth Bs+Bj is transmitted. That is, the frequency bandwidth of the jamming signal 12 may be equal to a sum of the frequency bandwidth of the receipt signal and the chirp noise modulation bandwidth of the chirp noise.

The jamming signal 12 to which the chirp noise is added is outputted through the matching filter of the radar 10. In a same manner as in Equation 2, the jamming signal 12 to which the chirp noise is added may be outputted as shown in Equation 9 through the matching filter of the radar 10.

$$S_{out}(t) = \int_{-T_s/2}^{T_s/2} \exp\Big( j\pi(K_s + K_j)(t-\tau)^2 \exp(j\pi K_s \tau^2) d\tau = \exp\Big(-j\pi \frac{K_s}{K_j}(K_s + K_j)t^2\Big) \frac{1}{\sqrt{j\pi K_j}} \int_{-\sqrt{j\pi K_j}\left(\frac{T}{s} - \left(\frac{K_Q}{K_j}+1\right)t\right)}^{\sqrt{j\pi K_j}\left(\frac{T}{s} - \left(\frac{K_Q}{K_j}+1\right)t\right)} \exp(r^2) dr = \exp\Big(-j\pi \frac{K_s}{K_j}(K_s + K_j)t^2\Big) \frac{-1}{\sqrt{j\pi K_j}} \Big[ erfi\Big(\sqrt{j\pi K_j}\Big(\frac{T}{2} + \frac{K_s}{K_j} + 1\Big)t\Big)\Big) + erfi\Big(\sqrt{j\pi K_j}\Big(\frac{T}{2} - \Big(\frac{K_s}{K_j} + 1\Big)t\Big)\Big)\Big] \quad \text{(Equation 9)}$$

Herein, $$erfi(x) = \frac{2}{\sqrt{\pi}} \int_0^x e^{t^2} dt,$$

and the delay time and an intermediate frequency were set to 0.

When the signal of the compressed pulse to which Equation 9 is applied has a delay time of 1 [μs], a pulse width of 3 [μs], and an intra-pulse modulation bandwidth of 20 [MHz], only the target delay signal is received by the radar 10, passes through the matching filter, and the output signal is outputted as a sinc signal 300 with the time delay of 1 [μs] as shown in FIG. 5.

On the other hand, in the case of adding a chirp noise having a chirp noise bandwidth of 20 [MHz] to a target delay signal, an output signal outputted after passing through the matching filter of the radar 10 as shown in FIG. 6 is outputted as a noise signal instead of a sinc signal. That is, in accordance with the chirp noise generation device according to an embodiment of the present disclosure, it is possible to effectively interfere with the detection and tracking of the target of the radar 10 by synthesizing the generated chirp noise with the receipt signal by using the receipt signal and transmitting it.

While embodiments of the present disclosure have been particularly shown and described with reference to the accompanying drawings, the specific terms used herein are only for the purpose of describing the disclosure and are not intended to define the meanings thereof or be limiting of the scope of the disclosure set forth in the claims. Therefore, a person of ordinary skill in the art will understand that various modifications and other equivalent embodiments of the present disclosure are possible. Consequently, the true technical protective scope of the present disclosure must be determined based on the technical spirit of the appended claims.

What is claimed is:

1. A chirp noise generation device for a compressed pulse signal, comprising:

a receiving antenna;

a signal analysis unit configured to determine whether to perform an electronic attack by analyzing a receipt signal that is inputted through the receiving antenna; and a digital frequency storage configured to store the receipt signal that is inputted through the receiving antenna, to generate a chirp noise by using the receipt signal, to generate a jamming signal by synthesizing the receipt signal and the chirp noise, and to transmit the jamming signal when a control command indicating that the electronic attack needs to be performed is received from the signal analysis unit, wherein the digital frequency storage generates the jamming signal by summing a phase of the receipt signal and a phase of the chirp noise.

2. The chirp noise generation device of claim 1, wherein the signal analysis unit analyzes the receipt signal and transmits a pulse width and a chirp noise modulation bandwidth to the digital frequency storage.

3. The chirp noise generation device of claim 2, wherein the digital frequency storage generates the chirp noise based on the pulse width and the chirp noise modulation bandwidth received from the signal analysis unit.

4. The chirp noise generation device of claim 1, wherein the phase of the receipt signal is calculated by using an equation $$\theta_s = \text{atan}\Big(\frac{Q}{I}\Big),$$

wherein $\theta_s$ indicates the phase of the receipt signal, I indicates a magnitude of an in-phase, and Q indicates a magnitude of a quadrature phase.

5. A chirp noise generation device for a compressed pulse signal, comprising:

a receiving antenna;

a signal analysis unit configured to determine whether to perform an electronic attack by analyzing a receipt signal that is inputted through the receiving antenna; and a digital frequency storage configured to store the receipt signal that is inputted through the receiving antenna, to generate a chirp noise by using the receipt signal, to generate a jamming signal by synthesizing the receipt signal and the chirp noise, and to transmit the jamming signal when a control command indicating that the electronic attack needs to be performed is received from the signal analysis unit;

wherein the digital frequency storage generates the jamming signal by multiplying the receipt signal and the chirp noise in a time domain.

6. A chirp noise generation device for a compressed pulse signal, comprising:

a receiving antenna;

a signal analysis unit configured to determine whether to perform an electronic attack by analyzing a receipt signal that is inputted through the receiving antenna; and a digital frequency storage configured to store the receipt signal that is inputted through the receiving antenna, to generate a chirp noise by using the receipt signal, to generate a jamming signal by synthesizing the receipt signal and the chirp noise, and to transmit the jamming signal when a control command indicating that the electronic attack needs to be performed is received from the signal analysis unit;

wherein a frequency bandwidth of the jamming signal is equal to a sum of a frequency bandwidth of the receipt signal and the chirp noise modulation bandwidth.

7. A chirp noise generation method for a compressed pulse signal, comprising:

receiving a chirp noise modulation bandwidth and a pulse width of a chirp noise depending on analysis contents of a receipt signal inputted through a receiving antenna;

generating the chirp noise based on the pulse width and the chirp noise modulation bandwidth; and generating a jamming signal by synthesizing the receipt signal and the chirp noise, and transmitting the jamming signal;

wherein the jamming signal is generated by summing a phase of the receipt signal and a phase of the chirp noise.

8. The chirp noise generation method of claim 7, further comprising:

determining whether to perform an electronic attack by analyzing the receipt signal; and storing the receipt signal depending on a control command indicating that the electronic attack needs to be performed.

9. The chirp noise generation method of claim 7, wherein the phase of the receipt signal is calculated by using an equation $$\theta_s = \operatorname{atan}\left(\frac{Q}{I}\right),$$

wherein $\theta_s$ indicates the phase of the receipt signal, I indicates a magnitude of an in-phase, and Q indicates a magnitude of a quadrature phase.

10. A chirp noise generation method for a compressed pulse signal, comprising:

receiving a chirp noise modulation bandwidth and a pulse width of a chirp noise depending on analysis contents of a receipt signal inputted through a receiving antenna;

generating the chirp noise based on the pulse width and the chirp noise modulation bandwidth; and generating a jamming signal by synthesizing the receipt signal and the chirp noise, and transmitting the jamming signal;

wherein the jamming signal is generated by multiplying the receipt signal and the chirp noise in a time domain.

11. A chirp noise generation method for a compressed pulse signal, comprising:

receiving a chirp noise modulation bandwidth and a pulse width of a chirp noise depending on analysis contents of a receipt signal inputted through a receiving antenna;

generating the chirp noise based on the pulse width and the chirp noise modulation bandwidth; and generating a jamming signal by synthesizing the receipt signal and the chirp noise, and transmitting the jamming signal;

wherein a frequency bandwidth of the jamming signal is equal to a sum of a frequency bandwidth of the receipt signal and the chirp noise modulation bandwidth.

* * * * *